US006960077B2

(12) United States Patent
Buccilli et al.

(10) Patent No.: US 6,960,077 B2
(45) Date of Patent: Nov. 1, 2005

(54) LOW NOISE MODULAR BLADE BURNER

(75) Inventors: Giorgio Buccilli, Monza (IT); Luca Barozzi, Sassuolo (IT); Feliciano Lasagni, Vignola (IT); Sandro Lugli, Modena (IT)

(73) Assignee: Worgas Bruciatori S.r.L., Modena (IT)

( * ) Notice: Subject to any disclaimer, the term of this patent is extended or adjusted under 35 U.S.C. 154(b) by 0 days.

(21) Appl. No.: 10/381,344

(22) PCT Filed: Sep. 25, 2001

(86) PCT No.: PCT/IB01/01751

§ 371 (c)(1),
(2), (4) Date: Sep. 3, 2003

(87) PCT Pub. No.: WO02/27237

PCT Pub. Date: Apr. 4, 2002

(65) Prior Publication Data

US 2004/0033458 A1 Feb. 19, 2004

(30) Foreign Application Priority Data

Sep. 26, 2000 (IT) ..... MO2000A0198

(51) Int. Cl.[7] ..... F23D 14/62
(52) U.S. Cl. ..... 431/354; 431/328; 239/553
(58) Field of Search ..... 431/354, 328; 239/553, 566, 565

(56) References Cited

U.S. PATENT DOCUMENTS 1,596,452 A * 8/1926 Reeves et al. ..... 239/553
2,541,710 A * 2/1951 Miller ..... 239/565
3,773,075 A * 11/1973 Thompson et al. ..... 431/354
6,461,152 B2 * 10/2002 Wood et al. ..... 431/354

FOREIGN PATENT DOCUMENTS

| | | |
|---|---|---|
| EP | 0 052 191 | 5/1982 |
| EP | 0 657 691 | 6/1995 |
| GB | 819 723 | 9/1959 |
| GB | 992 086 | 5/1965 |
| GB | 2 310 489 | 8/1997 |
| JP | 06 331109 | 11/1994 |

* cited by examiner

*Primary Examiner*—Alfred Basichas
(74) *Attorney, Agent, or Firm*—Collard & Roe, P.C.

(57) ABSTRACT

A burner (1), fed with a mixture of fuel and air, comprising a body (2) consisting of two half-shells having a plane of symmetry, inside said body a Venturi tube (3) being defined, provided with and inlet (4) into which said mixture of fuel and air is introduced, said Venturi tube (3) communicating upwardly with a distributing chamber (5) of said mixture of fuel and air, said distributing chamber (5) communicating upwardly with a burner head (8), closed upwardly by a diffuser (9), on which openings are made for the outflow and the subsequent combustion of said mixture of fuel and air, said distributing chamber (5) exhibits a first portion (6) and a second portion (7), said first portion (6), communicating with said Venturi tube, comprising at least a first stretch (6*a;* 6*c;* 6*e*) having a cross section of substantially constant width and at least a second stretch (6*b;* 6*d*) having cross section that increases progressively along a direction parallel to said plane of symmetry towards an end of said distributing chamber (5) faraway with respect to said Venturi tube (3), said second portion (7) having a section that increases progressively towards said burner head (8).

10 Claims, 2 Drawing Sheets

LOW NOISE MODULAR BLADE BURNER

The invention relates to a low noise burner of the so-called "modular blade" type.

Under a so-called "modular blade" burner, a burner is intended provided with a plurality of burner bodies, each of which constitutes a mixing and distributing element for a flow of mixture of gaseous fuel and air. Said burner bodies are of modular type and may be assembled in packs. Inside each burner body a Venturi tube is obtained leading into a chamber placed at the outlet of said Venturi tube; said chamber communicating upwardly with a burner head closed upwardly by a diffuser, whereon openings are made, for example slots, for the outflow of the mixture of gaseous fuel and air.

A problem of said burners is that they are noisy in operation because of the turbulence that the mixture of gaseous fuel and air shows at the outlet of the slots made on the diffuser of the burner, this turbulence may further produce instability of the flames generated by the combustion of said mixture. Such turbulence is generally also affected by turbulences that occur inside the Venturi tube.

It is an object of the present invention to provide a burner of the so-called "modular blade" type, that exhibits low noise and high stability of the flames generated by the combustion of the mixture.

According to the present invention, a burner of the so-called "modular blade" type is provided, fed with a mixture of fuel and air, comprising a body consisting of two half-shells having a plane of symmetry, inside said body a Venturi tube being defined provided with an inlet into which said mixture of fuel and air is introduced, said Venturi tube communicating with a distributing chamber for said mixture of fuel and air, said distributing chamber communicating upwardly with a burner head, closed upwardly by a diffuser, on which openings are made for the outflow and the subsequent combustion of said mixture of fuel and air, characterized in that said distributing chamber exhibits a first portion and a second portion, said first portion, communicating with said Venturi Tube, comprising at least a first stretch having a substantially constant cross section and at least a second stretch having a cross section that increases progressively along a direction parallel to said plane of symmetry towards an end of said distributing chamber faraway with respect to said Venturi tube, said second portion having a cross section towards that increases progressively toward said burner head.

By properly selecting the length of said first stretch and said second stretch, it is possible to prevent the breakaway of the flowing stream of said mixture of gaseous fuel and air from the diverging walls of the second portion of the combustion chamber, by preventing the formation of vortices, that cause noise and instability of the flame.

According to a preferred version of the present invention, three parallel flow paths for said mixture are obtained inside the burner head, a central flow path and two side flow paths arranged at opposite sides with respect to said central flow path, a set of openings for the outflow of said mixture corresponding, on the burner diffuser, to each flow path.

It is well known that the flames generated by the flows of mixture conveyed into the side flow paths act as pilot flames for the flames generated by the flow of mixture conveyed into the central flow path. The flow paths are so shaped that the output speed of the mixture conveyed into said side flow paths is remarkably lower than the speed of the mixture flowing out through the openings placed at said central flow path, that in order to make easier for the flames generated by the flow of mixture conveyed into said central flow path to anchor themselves on the surface of the diffuser.

The output speed of the mixture conveyed into said central flow path and the output speeds of the mixture conveyed into said side flow paths are remarkably constant along a direction substantially parallel to the axis of the burner. That enables the noise produced by the flames generated by the combustion of said flows of mixture to be substantially reduced.

The invention may be better understood and carried out from the following description, made for merely indicative and not restrictive purpose, with reference to the enclosed drawings wherein.

Figure 1:
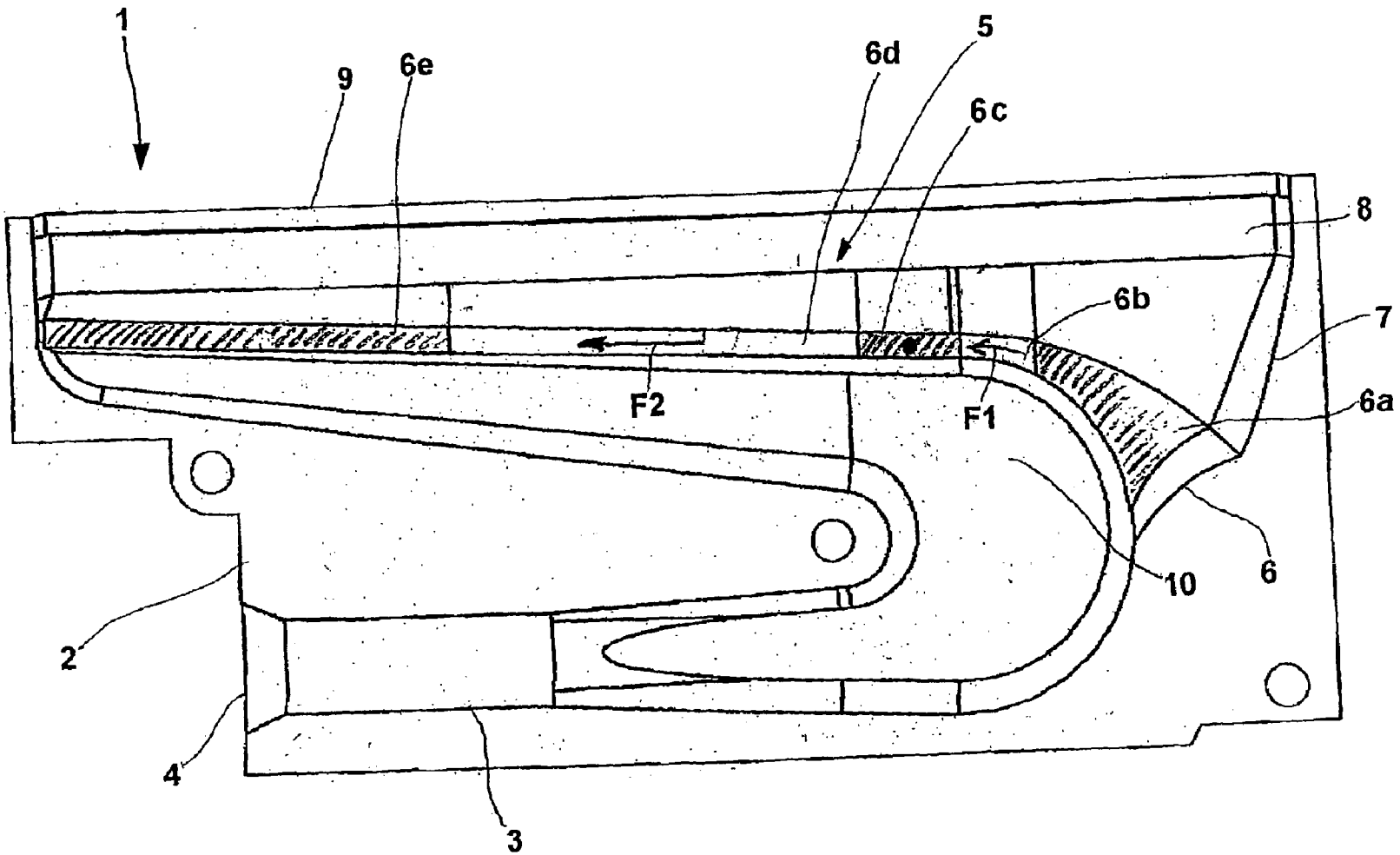
FIG. 1 is a longitudinal section of a burner according to the invention, made along the plane of symmetry of the burner.
Figure 2:
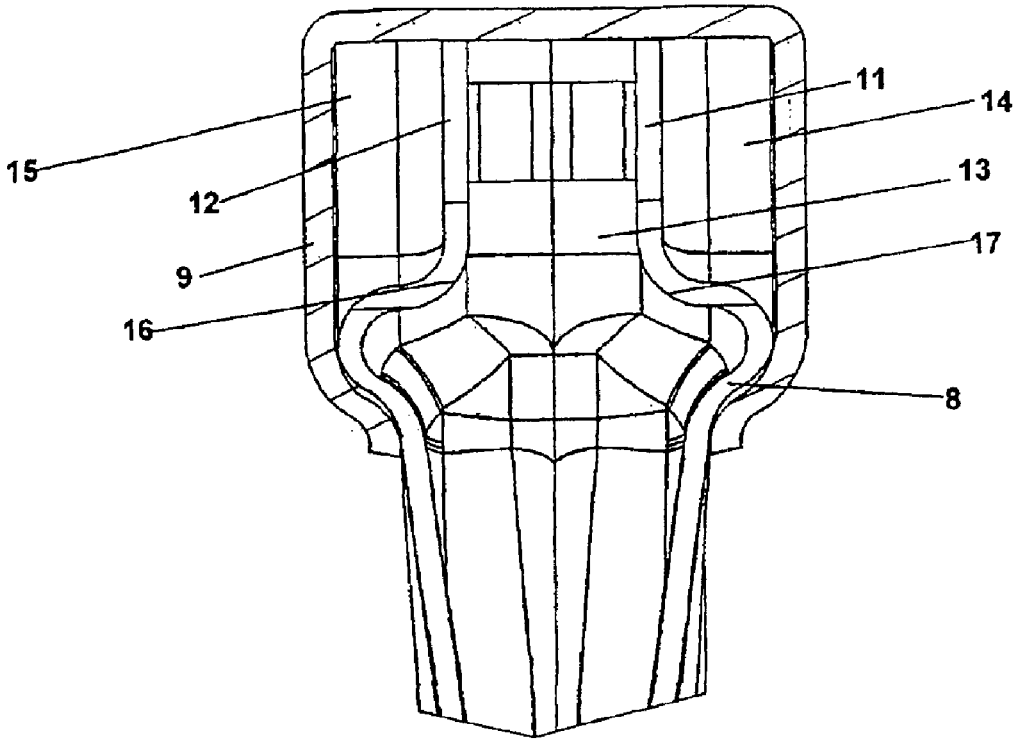
FIG. 2 is a cross section of the burner head.

In FIG. 1 a burner is shown according to the invention, provided with a body 1 consisting of 2 substantially symmetric shells facing each other, between which a Venturi tube 3 is defined, said Venturi tube being provided with an inlet 4 through which a mixture of fuel and air is introduced. In the upper portion of the body 1, between the two half-shells 2, a distributing chamber 5 is defined for said mixture of air and fuel. The distributing chamber 5 is divided into a lower portion 6, communicating with said Venturi tube 3 and an upper portion 7, which communicates downwardly with said lower portion 6 and upwardly with the head 8 of the burner. The burner head 8 is closed upwardly by a diffuser 9, on which some openings are made for the outflow and the subsequent combustion of said mixture of fuel and air. Said lower portion 6 comprises a first stretch 6*a* having a substantially constant width in a direction perpendicular to the plane of FIG. 1, said first stretch 6*a* lying at the outlet 10 of the Venturi tube. The first stretch 6*a* is followed by a second stretch 6*b* having a width that increases progressively, preferably a width that increases linearly, in the direction of the arrow F1, i.e. starting from said outlet 10 of the Venturi tube 3, the minimal width of said second stretch 6*b* being substantially equal to the width of said first stretch 6*a*. The second stretch 6*b* is followed by a third stretch 6*c* having a substantially constant width, equal to the greatest width of the second stretch 6*b*. The third stretch 6*c* is followed by a fourth stretch 6*d* having a width that increases progressively, preferably a width that increases linearly, in the direction of the arrow F2, i.e. starting from said outlet 10 of the Venturi tube 3, the minimal width of said fourth stretch 6*d* being substantially equal to the width of said third stretch 6*c*. The fourth stretch 6*d* is followed by a last stretch 6*e* having a substantially constant width, substantially equal to the greatest width of said fourth stretch 6*d*. The width of the lower portion 6 of the distribution chamber 5 is therefore minimal in the region of the chamber 5 closer to the outlet 10 of the Venturi tube 3 and maximal in the region of the chamber 5 remote from said outlet 10.

The upper portion of the distributing chamber 5 has a width that increases progressively towards the burner head 8.

By properly choosing the length of the stretches 6*b* and 6*d* of the lower portion 6 of the distributing chamber 5, the width increment of said stretches and the width increment of the upper portion 7 of the distributing chamber 5, it is possible to obtain, into the burner head 8, immediately before the diffuser 9, a substantially constant distribution of pressure along a longitudinal direction, i.e. along a direction parallel to the plane of the FIG. 1, and to prevent the breakaway of the flowing stream of mixture from the walls of the distributing chamber 5 and the burner head 8, so that the flow of mixture flowing out from the openings of the diffuser 9 is substantially free from vortices and therefore results in a very noiseless combustion, with high stability of the flame.

In order to further improve the stability of the flame, the burner head 8 is provided, at its interior, with a pair of separating walls 11 and 12, dividing the interior of the head 8 into three parallel flow paths for said mixture of fuel and air: a central flow path 13 and two side flow paths 14 and 15. On the diffuser 9 of the burner, a set of openings for the outflow of the mixture of fuel and air corresponds with each flowing path. The inlet sections 16 and 17 of the side flow paths 14 and 15 are remarkably smaller than the inlet section of the central flow path, so that the flow rate of the mixture of fuel and air through the side flow paths 14 and 15 is remarkably lower than the flow rate of said mixture through the central flow path 13 and the speed of the mixture exiting from said side flow paths is lower than the speed of the mixture exiting from the central flow path, due to the pressure drop caused by the reduced area of the inlet sections 16, 17. In such a way it is obtained that the flames generated by the combustion of the portions of mixture passing through the side flow paths 14 and 15 can act as pilot flames for the flames generated by the portion of mixture passing through the central flow path, thus assuring a high stability of flame.

Figure 3:
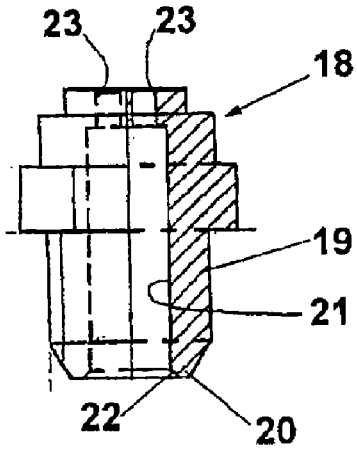
FIG. 3 is an axial section of an fuel injecting nozzle suitable for being used in a burner according to the invention.

In the FIG. 3 a fuel injecting nozzle 18 of known type is shown, that is advantageous to be used in a burner according to the invention, in order to further reduce the noise produced during combustion. The injecting nozzle 18 comprises a body 19, an end 20 of which may be connected to a fuel feeding duct (not shown). The nozzle 18 is provided with a central duct 21, communicating at a first end with a bore 22, by means of which the central duct 21 is placed in communication with said fuel feeding duct, and, at a second end, with two or more calibrated bores 23 for distributing said fuel. The nozzle 18 is positioned in known manner at the inlet 4 of the Venturi tube 3. The use of a nozzle with a plurality of distributing openings for the fuel enables to further reduce the noise of the burner according to the invention, since it reduces the vorticity of the mixture introduced into the Venturi tube 3.

In the practice, the materials, the dimensions and the execution details may be different from those indicated, but technically equivalent thereto, without leaving the juridical domain of the present invention. For example, the number of stretches having a variable width of the lower portion 6 of the combustion chamber 5 may be chosen depending on the overall geometry of the burner.

What is claimed is:

1. A burner suitable for being fed with a mixture of fuel and air comprising:

(a) a burner body comprising two half-shells having a plane of symmetry, (b) a Venturi tube provided within said body comprising an inlet for introduction of the mixture of fuel and air;

(c) a distributing chamber for the mixture of fuel and air comprising a first portion and a second portion, said first portion communicating with said Venturi tube and comprising one or more stretches having a cross-section of substantially constant width and one or more further stretches having a cross-section having a width that increases progressively along a direction parallel to said plane of symmetry towards an end of said distributing chamber remote from said Venturi tube;

(d) a diffuser provided with openings for outflow and subsequent combustion of the mixture of fuel and air; and (e) a burner head closed upwardly by said diffuser, said distributing chamber communicating upwardly with said burner head;

wherein said head comprises a plurality of substantially parallel flow paths for the mixture, said flow paths being separated from each other.

2. The burner according to claim 1 wherein said flow paths comprise a central flow path and two side flow paths arranged at opposite sides with respect to said central flow path.

3. The burner according to claim 2, wherein said side flow paths have inlets having a flow section for said mixture remarkably smaller than the flow section of the inlet of said central flow path.

4. The burner according to claim 1, wherein said flow paths are defined by separating walls arranged inside said head.

5. The burner according to claim 1 wherein said diffuser is provided with a plurality of sets of openings for the passage of said mixture, each set of openings corresponding to one of said flow paths.

6. The burner according to claim 5, wherein said openings are shaped as slots.

7. The burner according to claim 5, wherein the openings of the sets of openings corresponding to said side flow paths have a flow section for said mixture smaller than the flow section of the openings of the set of openings corresponding to said central flow path.

8. The burner according to claim 1 further comprising a fuel injecting nozzle provided with two or more distributing openings for said fuel.

9. A burner suitable for being fed with a mixture of fuel and air comprising:

(a) a burner body comprising two half-shells having a plane of symmetry;

(b) a Venturi tube provided within said body comprising an inlet for introduction of the mixture of fuel and air, (c) a distributing chamber for the mixture of fuel and air comprising a first portion and a second portion, said first portion communicating with said Venturi tube and comprising one or more stretches having a cross-section of substantially constant width and one or more further stretches having a cross-section having a width that increases progressively along a direction parallel to said plane of symmetry towards an end of said distributing chamber remote from said Venturi tube;

(d) a diffuser provided with openings for outflow and subsequent combustion of the mixture of fuel and air; and (e) a burner head closed upwardly by said diffuser, said distributing chamber communicating upwardly with said burner head wherein said second portion of said distributing chamber has a cross-section having a width increasing linearly towards said head.

10. The burner according to claim 9, further comprising a fuel injecting nozzle provided with two or more distributing openings for said fuel.

* * * * *